US006655107B2

(12) United States Patent
Dean

(10) Patent No.: US 6,655,107 B2
(45) Date of Patent: Dec. 2, 2003

(54) METHOD FOR REINFORCING HOLLOW CONCRETE BLOCK WALLS

(76) Inventor: Christopher J. Dean, 71 Rte. 34, Colts Neck, NJ (US) 07722

( * ) Notice: Subject to any disclaimer, the term of this patent is extended or adjusted under 35 U.S.C. 154(b) by 55 days.

(21) Appl. No.: 09/397,627

(22) Filed: Sep. 16, 1999

(65) Prior Publication Data

US 2002/0157344 A1 Oct. 31, 2002

(51) Int. Cl.[7] ..... E04B 1/00; E04G 21/00; E04G 23/00

(52) U.S. Cl. ..... 52/742.14; 52/742.1; 52/745.03; 52/309.16

(58) Field of Search ..... 52/742.14, 742.1, 52/742.16, 745.03, 741.13, 437, 438, 439, 504, 309.16, 309.17, 514, 514.5

(56) References Cited

U.S. PATENT DOCUMENTS

| | | | | | |
|---|---|---|---|---|---|
| 3,537,220 | A | | 11/1970 | Ellis | |
| 4,189,891 | A | | 2/1980 | Johnson | |
| 4,353,194 | A | | 10/1982 | Norton | |
| 4,452,028 | A | * | 6/1984 | Norton | 52/744 |
| 4,563,852 | A | * | 1/1986 | Achtenberg | 52/743 |
| 5,450,700 | A | * | 9/1995 | Hackman | 52/425 |

* cited by examiner

*Primary Examiner*—Carl D. Friedman
*Assistant Examiner*—Kevin McDermott
(74) *Attorney, Agent, or Firm*—Hedman & Costigan, P.C.

(57) ABSTRACT

The present invention relates to a method for reinforcing and repairing hollow concrete block building foundation walls from the bucking caused by the pressure of the earth, water and/or tree roots.

1 Claim, 10 Drawing Sheets

METHOD FOR REINFORCING HOLLOW CONCRETE BLOCK WALLS

FIELD OF THE INVENTION

The present invention relates to a method for reinforcing hollow concrete block building foundation walls from the buckling caused by the pressure of the earth, water and/or tree roots. The present invention teaches the insertion of structural reinforcing rods and the installation of structural grout into all hollow voids in the wall. The process of the invention provides an efficient method for reinforcing these walls.

The invention is typically used to reinforce and repair the buckling of foundations in residential and light commercial structures.

BACKGROUND OF THE INVENTION

While numerous prior inventions have taught methods for reinforcing hollow concrete block walls, such as Norton, U.S. Pat. No. 4,353,194; Ellis, U.S. Pat. No. 3,537,220; Auchtenberg, U.S. Pat. No. 4,563,852; and Johnson, U.S. Pat. No. 4,189,891, none of these contemplate a combination of structural rods, and pressurized structural grout which fills all hollow voids and provides extreme strength, as well as repairing the foundation by filling all cracks or damaged block.

OBJECTS OF THE INVENTION

It is an object of the present invention, therefore, to provide a method for reinforcing and repairing hollow concrete block foundation walls with great strength and cost efficiency.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
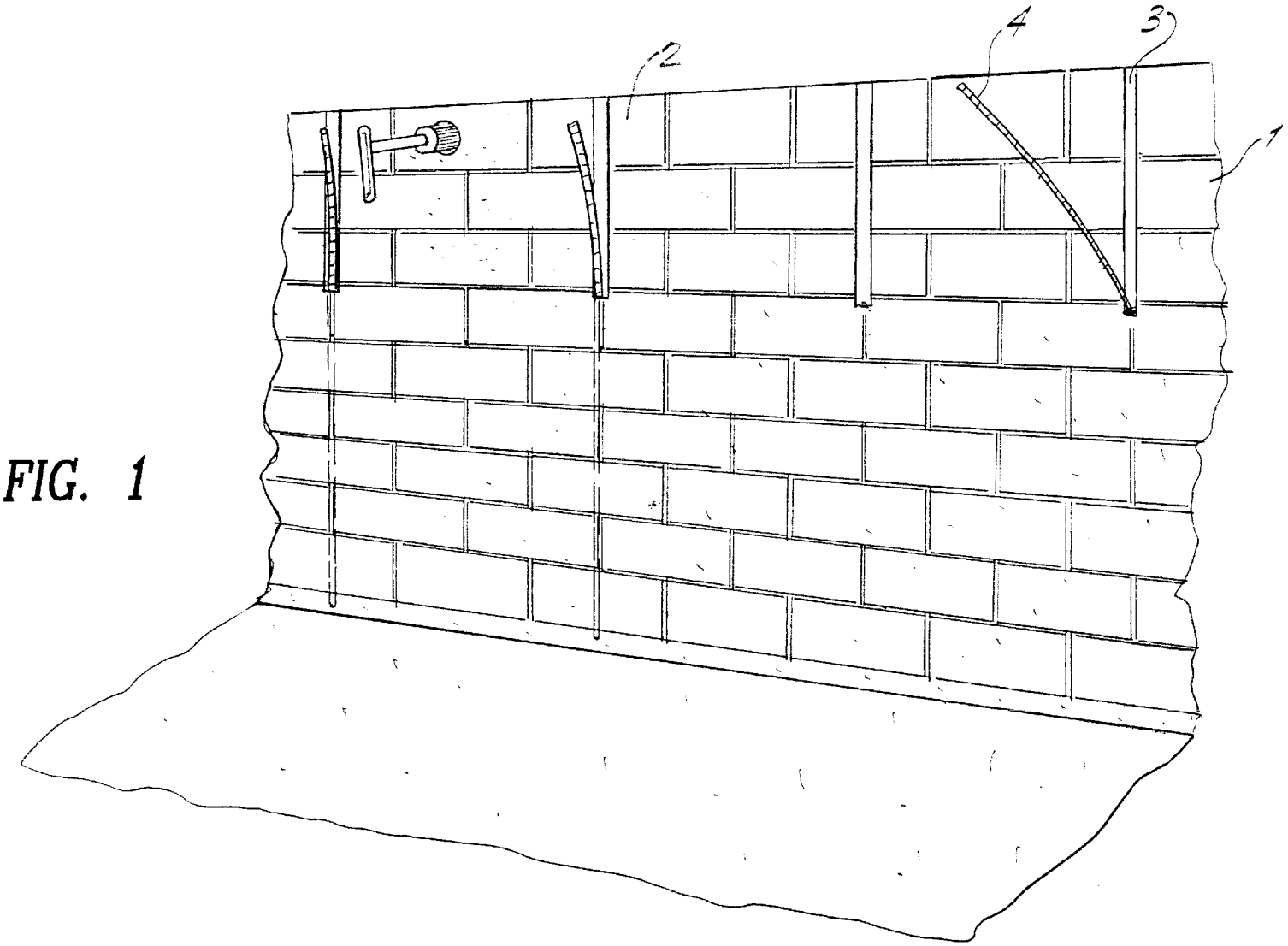
FIG. 1 is a perspective view of a site showing the various steps in the process at intermediate stages.

Referring to the drawings of the invention, as seen in FIG. 1, which shows all the elements of the method at various stages in the process. As seen, in FIG. 4, slices, 3, using a diamond blade saw, 10, are vertically cut through the exterior of a number of hollow concrete blocks, 2, which comprise the rows of a foundation wall, 1.

Figure 2:
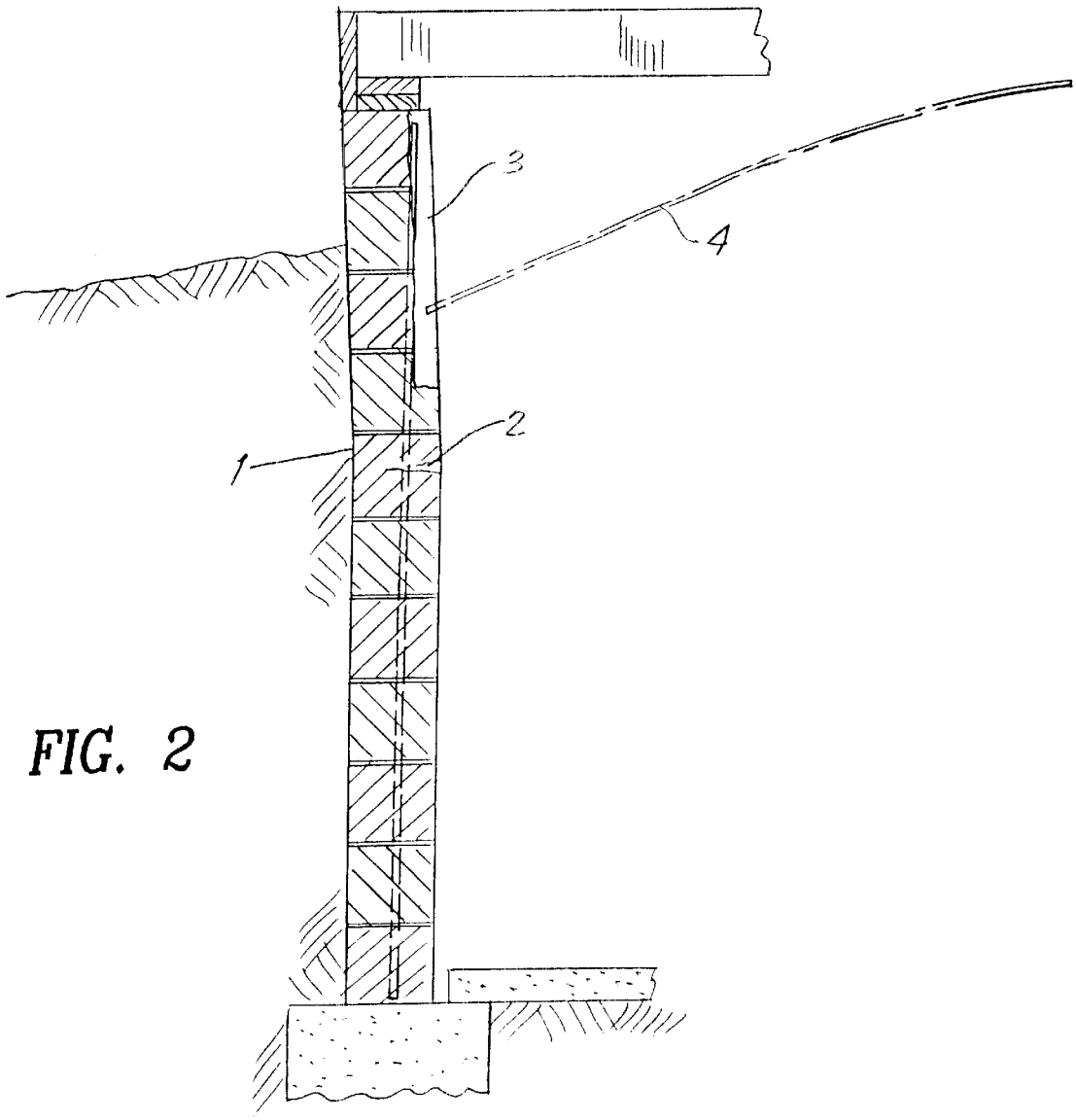
FIG. 2 is a side view of a hollow concrete block wall, showing the insertion of reinforcing bars.
Figure 3A:
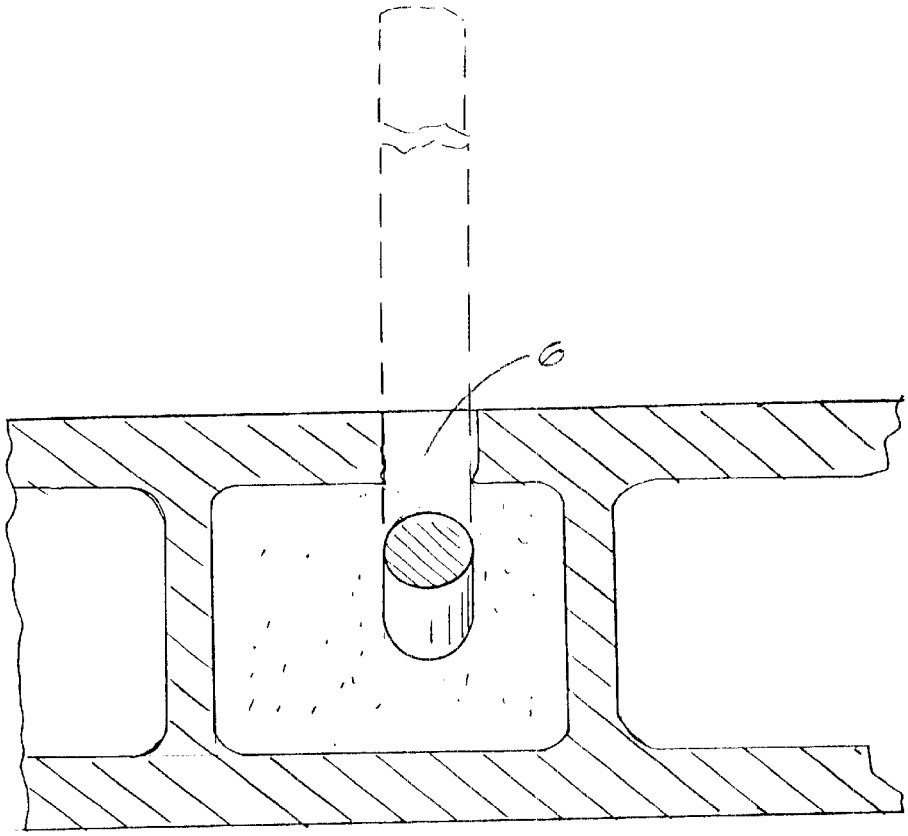
FIGS. 3A and 3B are top views of a hollow concrete block wall, showing the insertion of reinforcing bars.
Figure 3B:
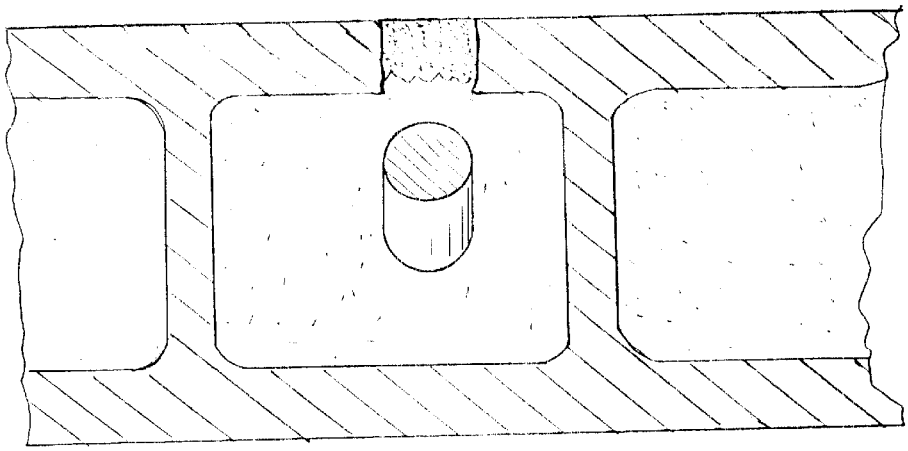
Figure 7:
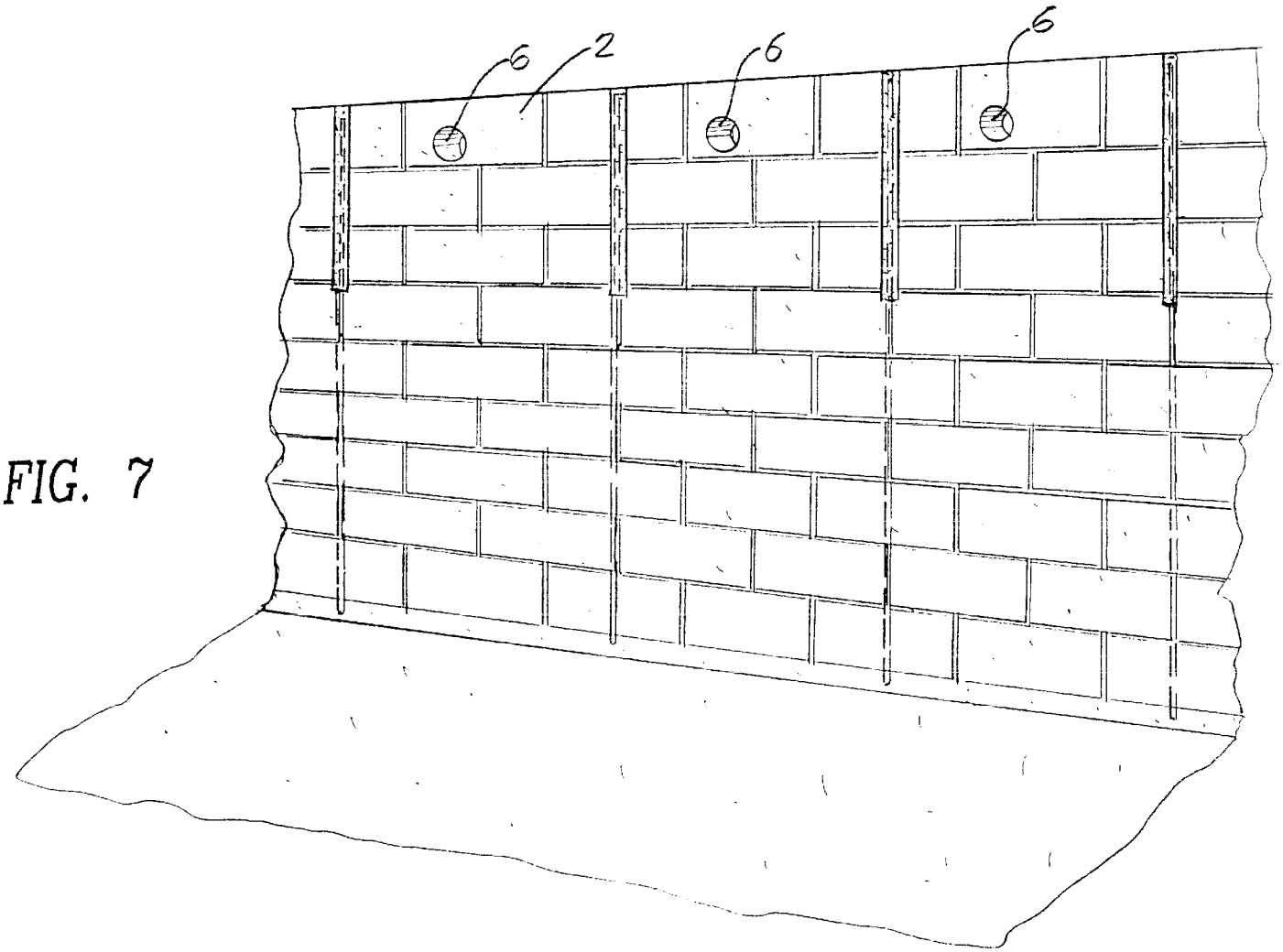
FIG. 7 is a perspective view showing the drilling of holes for the structural grout.

In addition, as is further seen in FIG. 1, a steel reinforcing bar, 4, is inserted into the hollow voids through the slices, 3. The slices are then sealed. This is further shown in FIG. 2. As seen in FIGS. 3A and 7, a hole, 6, is drilled horizontally into the blocks, 2, at predetermined locations. The hole extends into the hollow center of the block.

Figure 8:
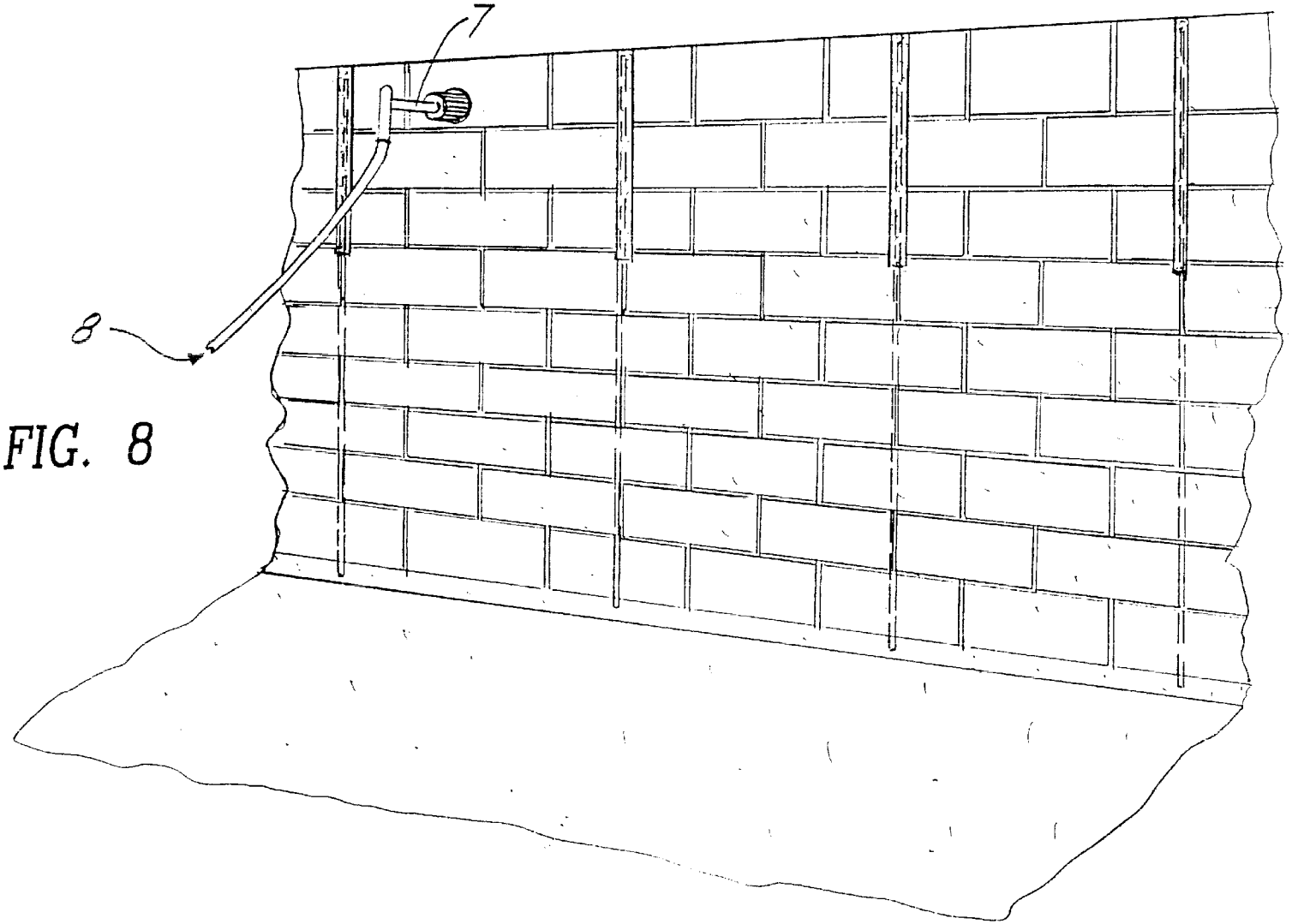
FIG. 8 is a perspective view showing the insertion of the structural grout into the wall under pressure.
Figures 9, 9A:
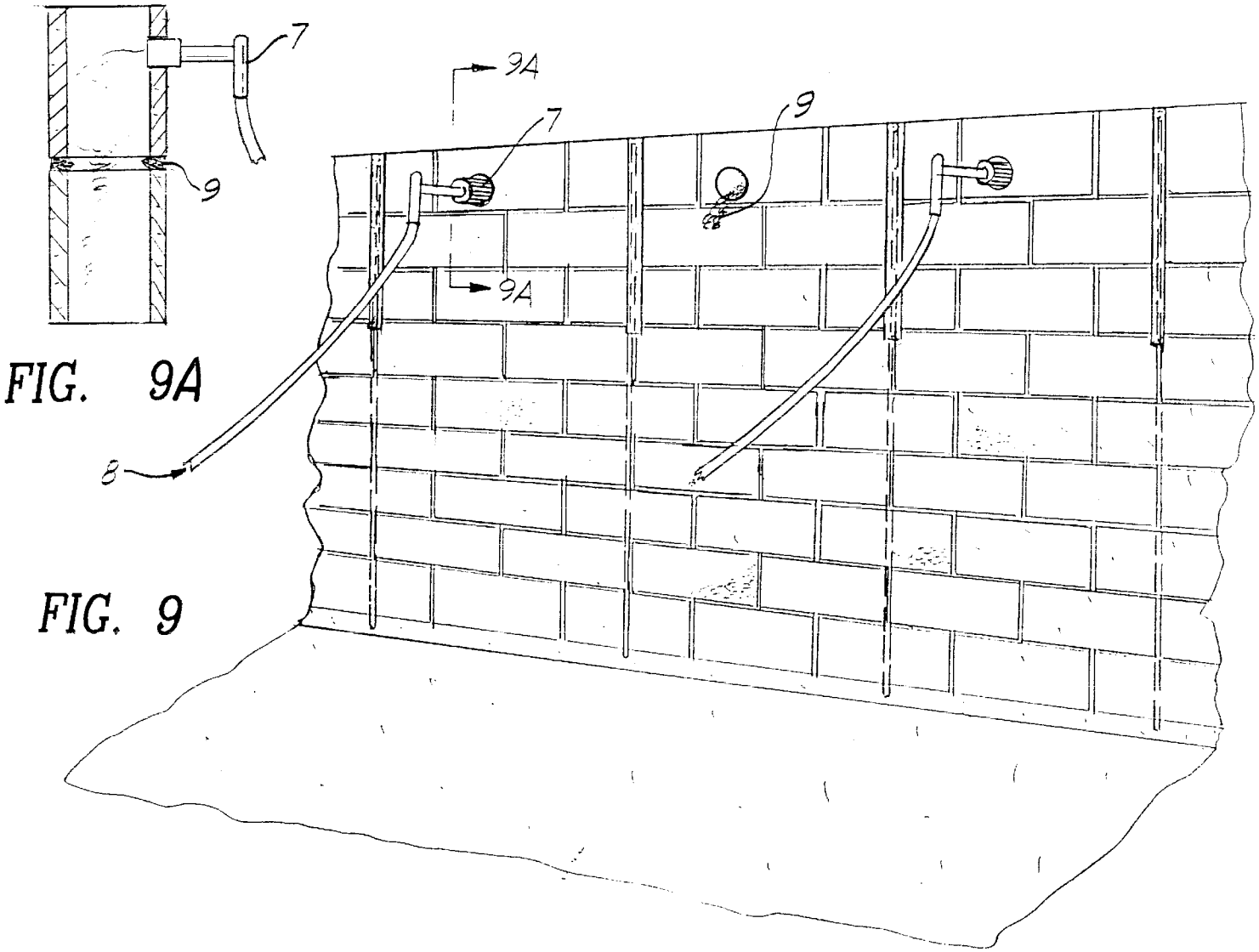
FIGS. 9 and 9A are perspective views showing the emerging of the structural grout from the wall.

As seen in FIG. 8, an insertion tool, 7, is inserted into the drilled hole and a mix of structural grout, 8, under moderate pressure is forced into the interior of the hollow blocks. The grout is produced by a grout plant, which is commonly used equipment in the cement industry. Typically the equipment mixes grout and dumps the mixture into hopper containing an agitator. A pump is typically connected to the hopper to drive the mixture, under pressure, through a hose, which is inserted into a wall. The pressure causes the mixture to fully fill the voids in a hollow block wall. FIG. 9, shows this being done simultaneously through two holes, until the grout begins to emerge through a hole in the middle, 9. This indicates that the interior of the wall is filled with structural grout. The drilled hole is patched with cement, as can be seen in FIG. 9A until all hollow blocks are filled, 4, and all the holes are sealed, 12.

Figure 4:
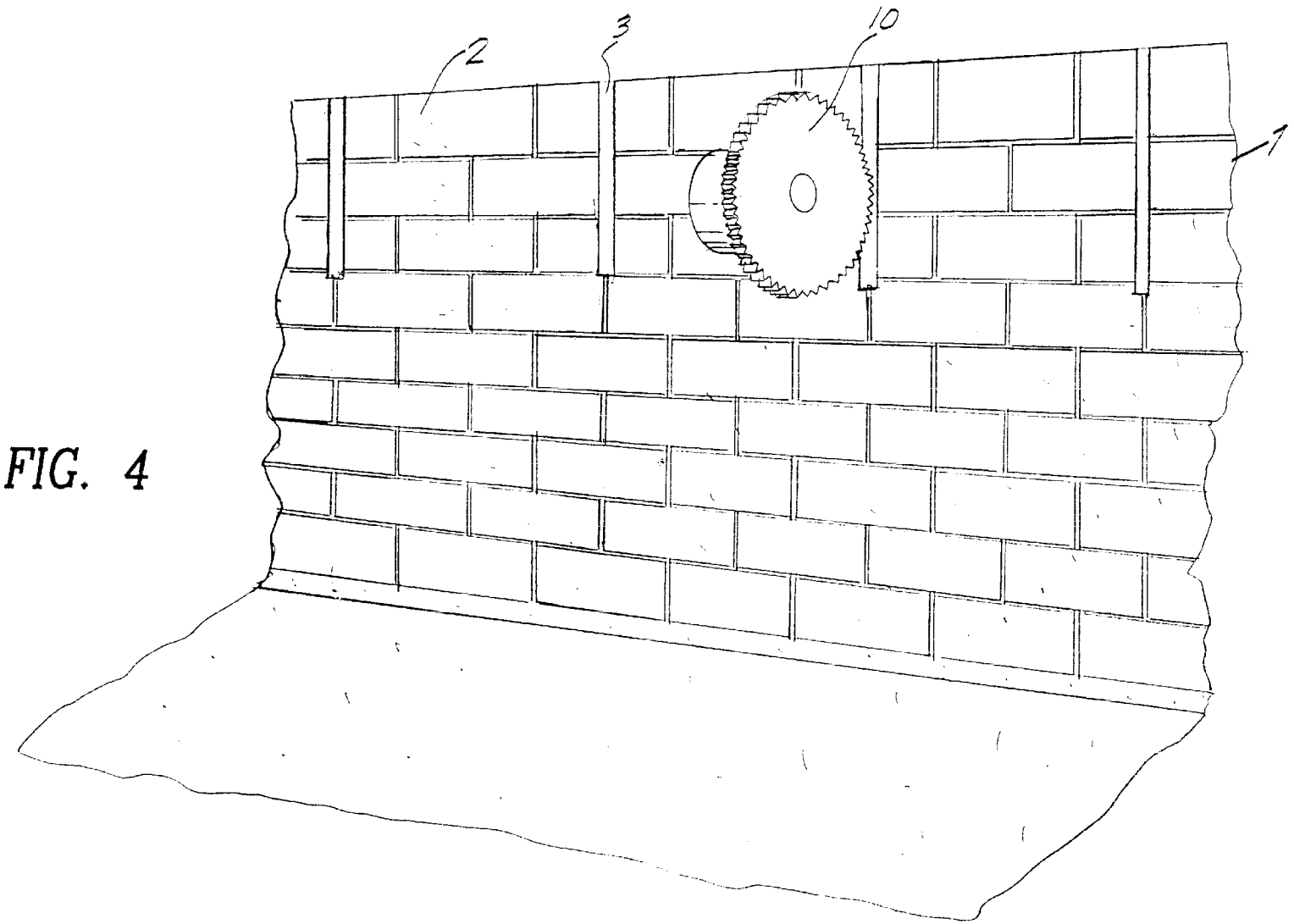
FIG. 4 is a perspective view showing the cutting of a slice in the wall.
Figure 5:
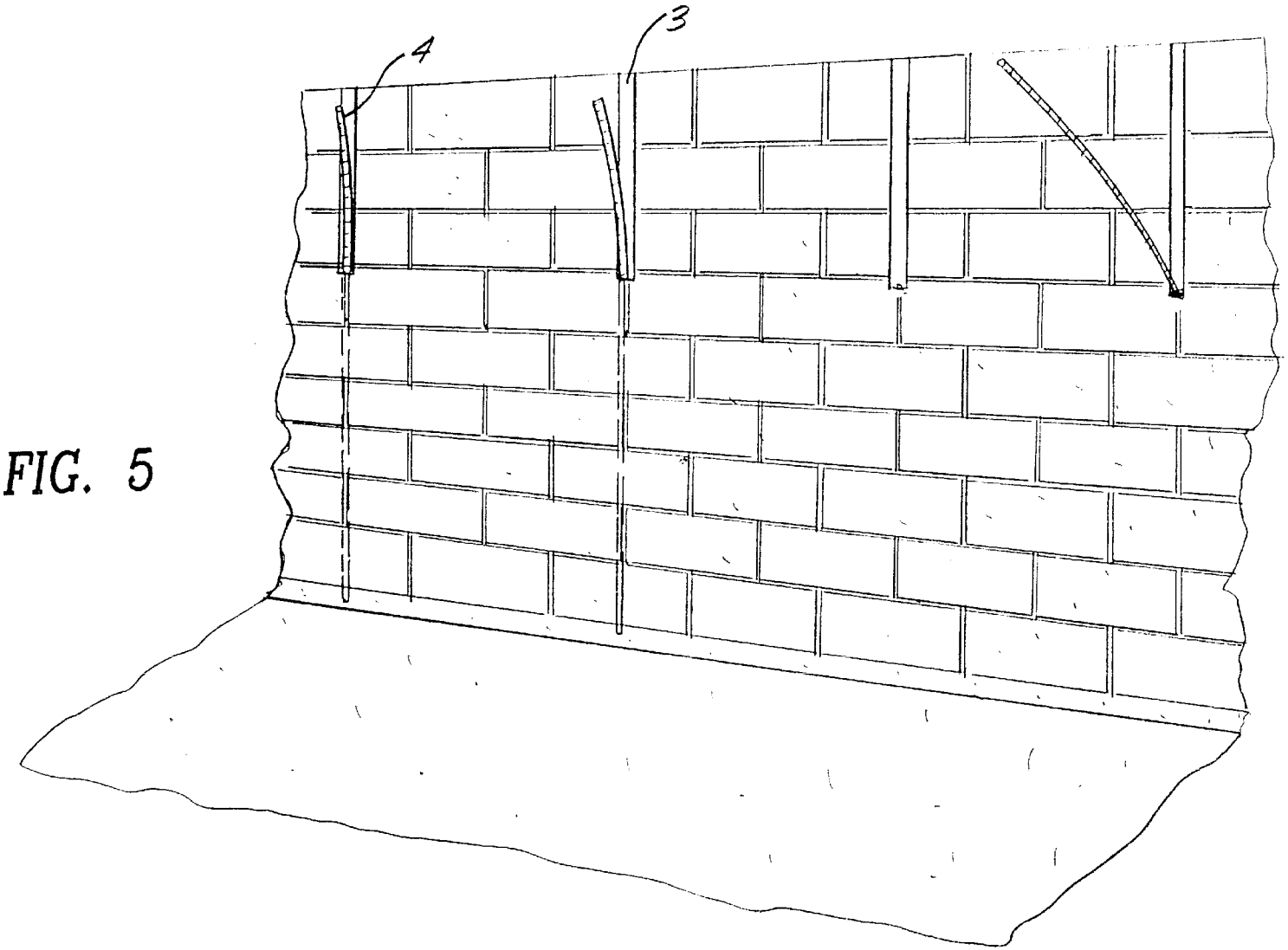
FIG. 5 is a perspective view showing the insertion of reinforcing bars in the slice.

As seen in FIG. 4 a slice is cut in the wall. A diamond saw, 10, is shown cutting a vertical slice, 3, in the wall. As seen in FIG. 5 reinforcing bars, 4, are inserted into the slice, 3.

Figure 6:
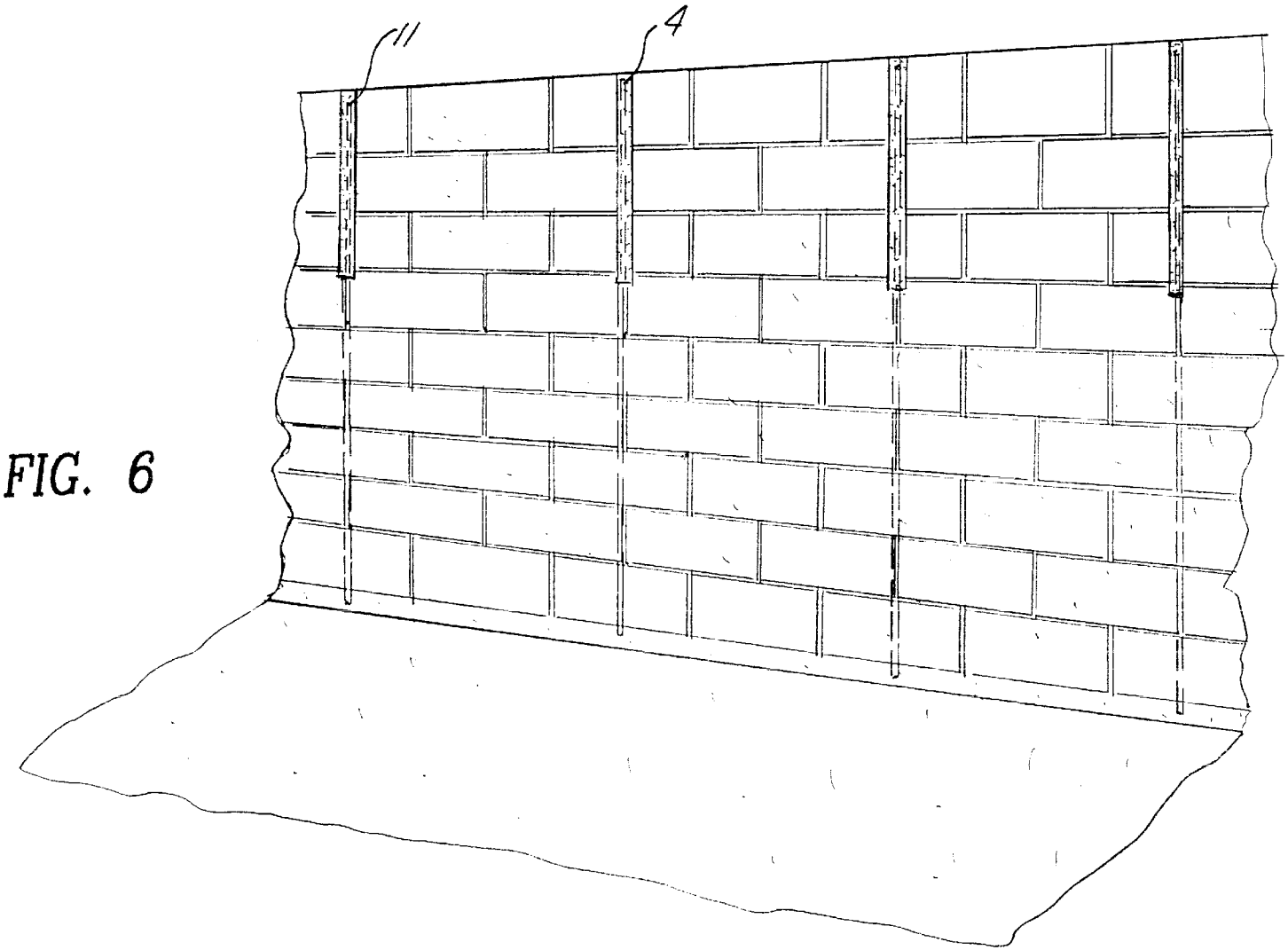
FIG. 6 is a perspective view showing the patching of the slice in the wall.

As seen in FIG. 6, the slice in the wall is patched, 11, over the reinforcing bar, 4.

As seen in FIG. 7 holes, 6, for the insertion of structural grout are drilled.

As seen in FIG. 8 structural grout, 8, is then inserted under pressure, via an insertion tool, 7, into the interior of the wall.

Figure 10:
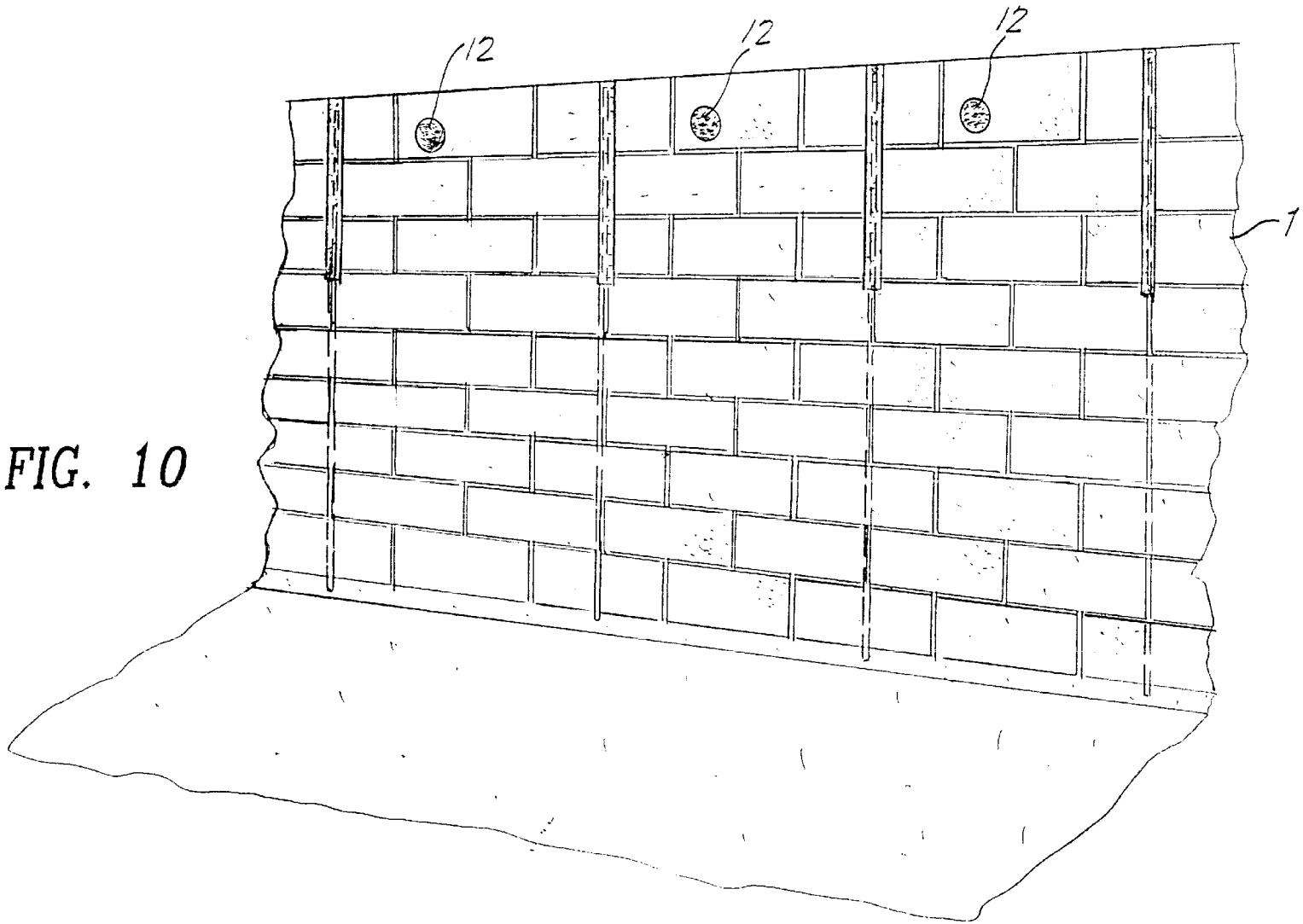
FIG. 10 is a perspective view showing the patching of the holes in the walls.

As seen in FIG. 9 and FIG. 9A, the structural grout, 9, emerges, indicating the completion of the wall. As seen in FIG. 10 the holes, 12, in the walls, 1 are then patched.

What I claim is:

1. A method for reinforcing and restoring building foundation walls consisting of rows of hollow interior concrete blocks, which comprises:

(a) Cutting a vertical slice into the interior of one or more hollow concrete blocks, said blocks being stacked in horizontal rows;

(b) Inserting a reinforcing bar vertically into the slice through the interior of one or more of the hollow concrete blocks;

(c) Patching the vertical slice with cement to cover said vertical slice;

(d) Drilling horizontal holes into the side of a concrete block at a particular row;

(e) Inserting a hollow pipe into the horizontal hole in the side of the concrete blocks;

(f) Inserting structural grout under moderate pressure through hoses connected to a grout plant and the hollow pipe into the interior of the concrete block until the structural grout emerges from successive holes in the wall;

(g) Patching the horizontal holes with cement;

(h) Repeating steps (d) through (g) until an entire wall is filled with structural grout.

* * * * *